US007500336B2

(12) United States Patent
McGivern et al.

(10) Patent No.: US 7,500,336 B2
(45) Date of Patent: Mar. 10, 2009

(54) MOLDED PANEL

(75) Inventors: Derek McGivern, Wallaceburg (CA); Paul Otto Kjeldsen, Mooretown (CA)

(73) Assignee: ThruFlow, Inc. (CA)

( * ) Notice: Subject to any disclaimer, the term of this patent is extended or adjusted under 35 U.S.C. 154(b) by 494 days.

(21) Appl. No.: 11/253,516

(22) Filed: Oct. 19, 2005

(65) Prior Publication Data

US 2007/0094980 A1 May 3, 2007

(51) Int. Cl.
*E04H 12/00* (2006.01)

(52) U.S. Cl. ..... 52/650.3; 52/177; 404/36

(58) Field of Classification Search ..... 52/650.3, 52/656.8, 660, 302.1, 177, 578; 404/36, 404/35, 41; 14/73
See application file for complete search history.

(56) References Cited

U.S. PATENT DOCUMENTS

| | | | | |
|---|---|---|---|---|
| 4,087,948 | A * | 5/1978 | Mellor | 52/180 |
| 5,628,160 | A | 5/1997 | Kueng | 52/591.1 |
| 5,642,592 | A | 7/1997 | Andres | 52/177 |
| 5,758,467 | A | 6/1998 | Snear et al. | 52/592.1 |
| 5,819,491 | A | 10/1998 | Davis | 52/592.1 |
| 5,839,247 | A * | 11/1998 | Beck | 52/519 |
| 5,992,106 | A * | 11/1999 | Carling et al. | 52/177 |
| 6,170,212 | B1 | 1/2001 | Suchyna et al. | 52/480 |
| 6,199,340 | B1 | 3/2001 | Davis | 52/592.1 |
| 6,226,950 | B1 | 5/2001 | Davis | 52/592.1 |
| 6,467,224 | B1 | 10/2002 | Bertolini | 52/177 |
| 6,637,163 | B2 | 10/2003 | Thibault et al. | 52/177 |
| 6,719,551 | B2 | 4/2004 | Polk, Jr. | 425/126.1 |
| 6,729,097 | B2 | 5/2004 | Patel et al. | 52/665 |
| 6,804,923 | B1 | 10/2004 | Potter | 52/480 |
| 6,869,558 | B2 | 3/2005 | Polk, Jr. et al. | 264/297.7 |
| 6,900,547 | B2 | 5/2005 | Polk, Jr. et al. | 257/777 |
| 6,918,221 | B2 | 7/2005 | Williams | 52/592.1 |
| 7,208,219 | B2 | 4/2007 | Polk, Jr. et al. | 428/292.1 |
| 7,303,800 | B2 * | 12/2007 | Rogers | 428/44 |
| 2002/0124512 | A1 * | 9/2002 | Dean | 52/506.01 |
| 2004/0080071 | A1 * | 4/2004 | Jo et al. | 264/136 |
| 2004/0253430 | A1 | 12/2004 | Polk, Jr. et al. | 428/292.1 |
| 2005/0108968 | A1 * | 5/2005 | Forster | 52/578 |
| 2006/0008967 | A1 | 1/2006 | Polk, Jr. et al. | 438/202 |

* cited by examiner

*Primary Examiner*—Richard E Chilcot, Jr.
*Assistant Examiner*—Anthony N Bartosik
(74) *Attorney, Agent, or Firm*—Bliss McGlynn, P.C.

(57) ABSTRACT

A deck panel is adapted to be secured on a supporting frame structure to create a deck surface. The deck panel comprises a thermoplastic material impregnated with a fibrous stranded material. The panel includes a top surface and four lateral sides extending downward from the top surface. The top surface is formed as a grid having a plurality of openings. A plurality of supporting ribs extend parallel to each other from one of the four lateral sides to an opposite one of the four lateral sides. The upper surface of each supporting rib is adapted to form longitudinal portions of the grid pattern of the top surface. A plurality of tabs extend outward from the lateral sides that are adapted to interlock with a corresponding plurality of tabs extending from a like deck panel so that a plurality of deck panels may be juxtaposed in abutting relationship.

7 Claims, 1 Drawing Sheet

MOLDED PANEL

BACKGROUND OF THE INVENTION

1. Field of the Invention

The present invention relates, generally to a molded panel and, more specifically, to a molded panel that interlocks together with like panels to form an open grid flooring surface over a support framework for deck areas or walkways.

2. Description of the Related Art

Generally speaking, there exists a wide variety of materials that may be employed to create a flooring surface to provide walkways and decks. Traditionally, wood was the material of choice. To ensure against rot and provide longer lasting surfaces, wood having high density and/or higher concentrations of natural oils, such as cedar, cypress, or redwood was chosen. These materials where especially useful for constructing docks and pier surfaces, which are constantly exposed to a harsh, wet environment. As material technologies progressed and the cost of these natural woods increased, other options became available. For example, pressure-treated wood, which uses more common and less expensive wood that is pressure impregnated with water resistant chemicals, was used to replace the natural woods. Most recently, long lasting plasticized and moldable materials have been employed in place of wood based materials for use as deck and dock surfaces. Generally, these materials are molded into deck panels that can be easily secured over a support framework to create the deck or dock surface. In this manner, the deck panels are pre-formed to a particular size and shape, and are also molded to add certain features that were not enjoyed by the natural material predecessors. In particular, pre-formed molded deck panels can be molded into a variety of shapes and colors, and they can be molded to include interlocking features that add strength and stability to the overall deck surface. The surface of the deck panels can also be molded as an open grid to provide drainage and light through the deck surface. Deck panels of these types have been used to cover decks of houses, boat docks, floating docks and other structures having their surface exposed to the environment.

Although the structure of the conventional molded deck panels mentioned above is generally adequate for the intended purpose, there is room for improvement. To provide adequate strength and support, conventional molded deck panels require fairly substantial amounts of moldable material for each panel. Additionally, the conventional deck panels that are molded in an open grid surface pattern require numerous reinforcing ribs underneath the top surface to provide the necessary rigidity and strength. The amount of moldable material required in each deck panel of this type makes them somewhat heavy for their size and limits their cost effectiveness over wood based materials. Furthermore, simply reducing the amount of moldable materials in the conventional deck panels greatly reduces their load carrying capability and their service life and is an undesirable alternative.

Accordingly, there remains a need in the related art for an improved pre-formed molded deck panel that can be molded in a open grid surface pattern and that requires less moldable material, and is lighter but as strong, or stronger than, conventional designs and is therefore more cost effective to produce and use. Furthermore, there remains a need for an improved pre-formed molded deck panel of this type that employs interlocking features to provide a strong, homogenous deck surface when installed.

SUMMARY OF THE INVENTION

The disadvantages of the related art are overcome by the molded deck panel of the present invention, which is adapted to be secured on a supporting frame structure to create a deck surface. The deck panel comprises a predetermined moldable thermoplastic material impregnated with a predetermined fibrous stranded material. The thermoplastic material is adapted to form the deck panel and provide a predetermined load carrying capacity. The panel includes a top surface and four lateral sides extending downward from the top surface. The top surface is formed as a grid having a plurality of openings. A plurality of supporting ribs extend parallel to each other from one of the four lateral sides to an opposite one of the four lateral sides. The supporting ribs are adapted to distribute loads placed upon the top surface and transfer the loads to the supporting frame structure. Each of the supporting ribs have a head portion with an upper surface and a lower surface and a leg portion. The upper surface of each head portion is adapted to form longitudinal portions of the grid pattern of the top surface. The leg portion extends downward from the lower surface of the head portion. A plurality of molded webs extend between the head portions of the parallel supporting ribs to join each of the head portions of the supporting ribs in the grid pattern of the top surface. A plurality of tabs extend outward from the lateral sides and are adapted to interlock with a corresponding plurality of tabs extending from a like deck panel so that a plurality of deck panels may be juxtaposed in abutting relationship to form the deck surface.

Thus, the present invention overcomes the limitations of the conventional deck panels by providing a lighter weight and stronger deck panel that is more cost efficient to produce. The panel employs less material which reduces mold cycle time and produces a deck panel that is lighter to ship, transport and install. This provides efficiency and cost savings to the manufacturer while providing the consumer with a stronger deck surface that is easier to install. The interlocking feature of the deck panels of the present invention also provides additional strength by creating an interlocked homogenous deck surface.

Other objects, features, and advantages of the present invention will be readily appreciated, as the same becomes better understood after reading the subsequent description taken in connection with the accompanying drawings.

DETAILED DESCRIPTION OF THE PREFERRED EMBODIMENT(S)

Figures 1, 2:
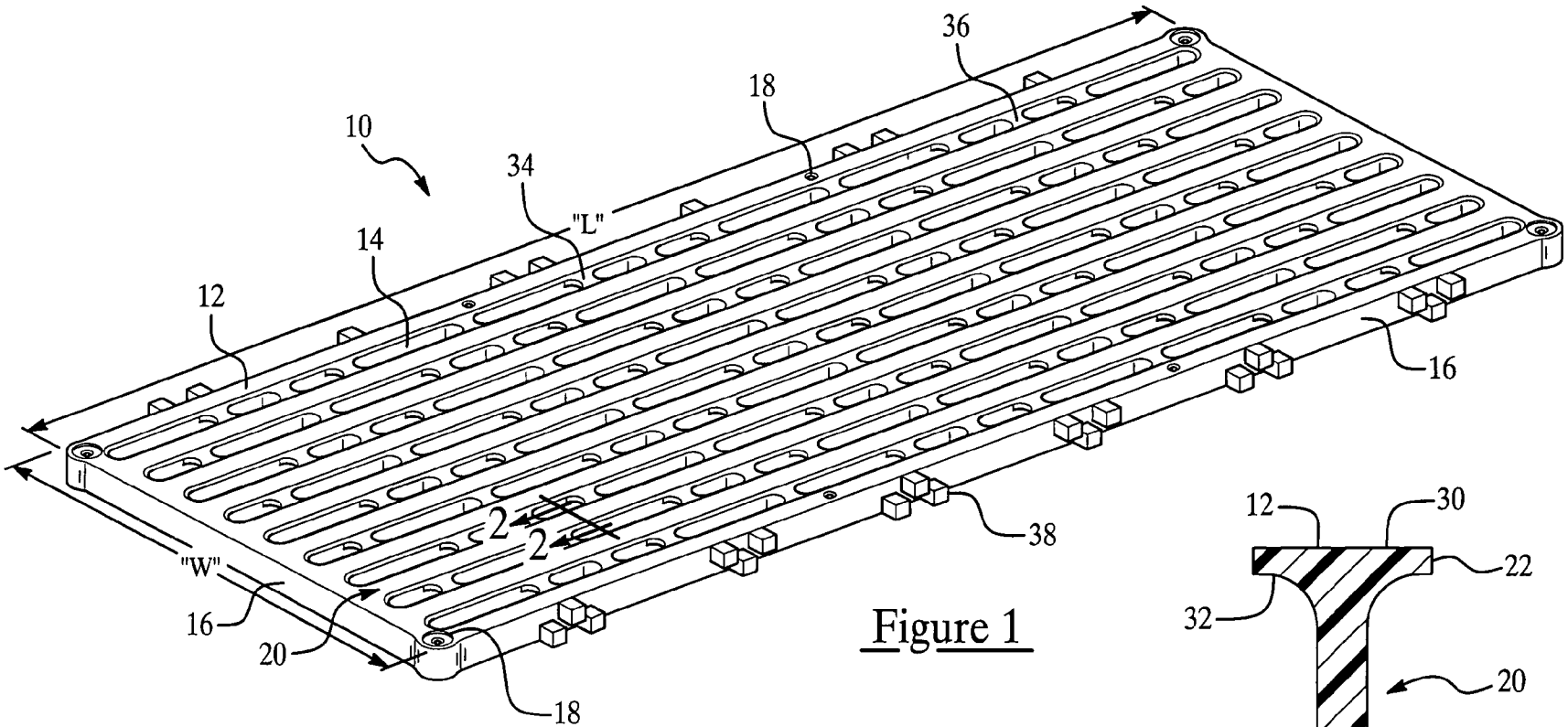
FIG. 1 is a perspective view of a pre-formed deck panel of the present invention.
FIG. 2 is a cross-sectional view of one of the supporting ribs of the deck panel of the present invention taken at section 2-2 of FIG. 1.

A deck panel of the present invention is generally indicated at 10 in FIG. 1. Specifically, the deck panel 10 is generally rectangular in shape and includes a top surface 12 that is formed having a grid pattern with a plurality of openings 14 through the top surface 12. The deck panel 10 further includes lateral sides 16 that extend downward from the top surface 12 on the outer periphery. In one embodiment, the molded deck panel 10 is rectangular in shape so that the top surface 12 has a length "L" and a width "W" with the length "L" greater than the width "W". However, those having ordinary skill in the art will appreciate from the description that follows that the deck panel 10 may have any suitable geometric shape.

The deck panel 10 is adapted to be secured to a supporting frame structure (not shown). The supporting frame structure may consist of a wooden frame mounted to a plurality of posts as is commonly found in decks and dock construction or may be any type of metal framework adapted to provide a walkway when fitted with a plurality of deck panels 10 of the present invention. The deck panel 10 is designed to be placed in its length "L" across the supporting members of the supporting frame structure. To allow the deck panel 10 to be held in place, a plurality of pre-formed openings 18 are formed through the top surface 12 at predetermined intervals along the length "L" to allow fasteners to be inserted in the openings 18 to contact and secure the deck panel 10 to the supporting frame structure. In one embodiment, to prevent a tripping hazard, the plurality of pre-formed openings 18 are recessed from the top surface 12 to allow the fasteners to be counter-sunk below the top surface 12. Further, to conform with generally acknowledged building practices, the deck panel 10 of the present invention is provided in two variants with regard to the placement of the openings 18. In the first variant, the openings 18 are located at every 16 inches along the length "L" of the top surface 12, and in the second variant the openings 18 are located at every 24 inches along the length "L" of the top surface 12.

A plurality of supporting ribs, generally indicted at 20, run parallel to each other from one of the four lateral sides 16 to an opposite one of the four lateral side 16. In one embodiment, the supporting ribs 20 extend in parallel relationship longitudinally along the length "L" of the deck panel 10. The supporting ribs 20 are adapted to distribute the weight of a load placed on the top surface 12 of the deck panel 10 and transfer the weight of the load to the supporting frame structure. As best shown in cross-section in FIG. 2, each of the supporting ribs 20 has a head portion 22 and a leg portion 24. The head portion 22 has an upper surface 30 and a lower surface 32. The upper surface 30 of the supporting ribs 20 form longitudinal portions of the grid pattern of the top surface 12 of the deck panel 10. The leg portion 24 is formed perpendicular to the head portion 22 such that the leg portion 24 extends downward from the lower surface 32 of the head portion 22.

To complete the grid pattern of the top surface 12, a plurality of molded webs 34 extend perpendicularly between the head portions 22 of the parallel supporting ribs 20 to join each of the head portions 22 of the supporting ribs 20 together in the grid pattern on the top surface 12. The molded webs 34 are formed periodically between the head portions 22 of the supporting ribs 20 along the length "L" of the deck panel 10 in repetitive patterns so as to cause the webs 34 to both align across the width "W" of the top surface 12 at predetermined points along the length "L" of the top surface 12 as shown at 36 in FIG. 1 and to be alternately offset across the width "W" of the top surface 12 along other portions of the length "L" of the top surface 12. In the embodiment illustrated herein, the webs 34 are slightly recessed below the top surface 12.

To create a homogenous deck surface over the supporting frame structure when all the adjustable deck panels 10 are in place, the deck panels 10 further include a plurality of tabs 38 extending outward from the lateral sides 16 of the deck panels 10 along their length "L." Each tab 38 is adapted to interlock with a corresponding plurality of tabs 38 extending from like deck panels 10. Thus, a plurality of deck panels 10 may be juxtaposed in abutting relationship to form the overall deck surface. In the embodiment illustrated in FIG. 1, the plurality of tabs 38 are formed as groups of three individual tabs. As shown, each group of individual tabs 38 have an alternate arrangement along the length "L" of the deck panel 10. It should be appreciated that the alternating arrangement of the groups of the tabs 38 along the length "L" of each deck panel 10 allows lengthwise abutting and interlocking of adjacent deck panels 10 without regard for a particular orientation. In other words, one length "L" of any deck panel 10 can interlock with either lengthwise side of any other deck panel 10. It should also be appreciated that the arrangement of the groups of tabs 38 allows each successive lengthwise row of deck panels 10 to be abutted and interlocked lengthwise in an offset manner so that the ends of the deck panels 10 need not be aligned with each other. In other words, each row of deck panels 10 placed on the supporting frame structure may be offset from one another so as to offer greater interlocking strength to the overall deck surface.

To provide an improved deck panel 10 that is lighter weight, and that requires less material while maintaining the strength and durability of conventional type deck panels. One embodiment of the deck panel 10 of the present invention is formed from a predetermined moldable thermoplastic material impregnated with a predetermined fibrous stranded material. The impregnated moldable thermoplastic material is adapted to be molded to form the deck panel and provide a predetermined load carrying capacity that exceeds conventional deck panels. In one acceptable process, the deck panel may be formed using an injection molding process. However, those having ordinary skill in the art will appreciate that other molding processes may be employed to manufacture the deck panel of the present invention. The best results for producing a lower mass deck panel having conventional or greater strength levels have been yielded by employment of various resin/polymers that have been impregnated with between 15 and 25% glass fibers by volume. More particularly, in the one embodiment, polypropylene compounds with approximately 20% impregnation of glass fibers by volume provide the greatest improvement over conventional deck panels.

To provide a greater aesthetic appeal, the predetermined moldable thermoplastic material of the deck panel 10 of the present invention may include any one of a group of predetermined colorants or pigments. The particular predetermined pigments are chosen from the wide variety currently available not only their particular ability to color the deck panel 10 but also for being generally inert to the structural properties of the thermoplastic material. Additionally, to provide a long-lasting deck surface and protect the thermoplastic compound from degradation when the deck panels 10 are exposed to the outside elements, the thermoplastic material of the deck panel 10 of the present invention further includes any one of a group of predetermined ultra-violet (UV) stabilizing compounds. The inclusion of the UV stabilizing compound extends the life of the deck panels by blocking the sun's UV rays, which can cause thermoplastic materials to turn brittle and lose their structural properties. Finally, as a safety measure, the pre-formed molded deck panel 10 of the present invention is molded so that the top surface 12 has an uneven texture to provide a non-slip decking surface.

Thus, the present invention overcomes the limitations of the conventional deck panels by providing a lighter weight and stronger deck panel produced from a thermoplastic material impregnated with glass fibers that is more cost efficient to produce. The panel employs less material which reduces mold cycle time and produces a deck panel that is lighter to ship, transport and install. This provides efficiency and cost savings to the manufacturer while providing the consumer with a stronger deck surface that is easier to install. Additionally, the impregnated thermoplastic material of the present invention is UV protected and produced in a variety of colors for the consumer. The interlocking feature of the deck panels of the present invention also provides additional strength by creating an interlocked homogenous deck surface. Further, the deck panels are produced to comply with standard building practices and include openings in the top surface at either 16 inch or 24-inch intervals for attachment to the supporting frame structure.

The invention has been described in an illustrative manner. It is to be understood that the terminology that has been used is intended to be in the nature of words of description rather than of limitation. Many modifications and variations of the invention are possible in light of the above teachings. Therefore, within the scope of the claims, the invention may be practiced other than as specifically described.

We claim:

1. A deck panel adapted to be secured on a supporting frame structure to create a deck surface, said deck panel comprising:

a thermoplastic material impregnated with a fibrous stranded material that form said deck panel and provide a predetermined load carrying capacity;

a top surface and four lateral sides extending downward from said top surface, said top surface defining a grid having a plurality of openings;

a plurality of supporting ribs that extend parallel to each other from one of said four lateral sides to an opposite one of said four lateral sides, said supporting ribs adapted to distribute loads placed upon said top surface and transfer said loads to the supporting frame structure, each of said supporting ribs having a head portion with an upper surface and a lower surface and a leg portion, said upper surface of each said head portion adapted to form longitudinal portions of said grid pattern of said top surface of said deck panel, said leg portion extending downward from said lower surface of said head portion, said head portion and leg cooperating to define a solid T-shape when viewed in cross-section so as to provide additional strength to said plurality of supporting ribs;

a plurality of molded webs that extend between said head portions of said parallel supporting ribs to join each of said head portions of said supporting ribs; and a plurality of tabs extending outward from said lateral sides adapted to interlock with a corresponding plurality of tabs extending from a like deck panel so that a plurality of said deck panels may be juxtaposed in abutting relationship to form said deck surface.

2. The deck panel as set forth in claim 1 wherein said top surface of said deck panel is rectangular in shape having a length and a width with said length greater than said width, said supporting ribs extending in parallel relationship longitudinally along the length of said rectangular deck panel.

3. The deck panel as set forth in claim 2 wherein said webs are formed periodically between the head portions of the supporting ribs along the length of the deck panel in repetitive patterns so as to cause said webs to both align across the width of the top surface at predetermined points along the length of the top surface and to be alternately offset across the width of the top surface along other portions of the length of the top surface.

4. The deck panel as set forth in claim 2 that further includes a plurality of openings through said top surface located at predetermined intervals along said length to allow fasteners to be inserted in said openings to contact and secure said deck panel to the supporting frame structure.

5. The deck panel as set forth in claim 4 wherein said plurality of openings through said top surface are recessed from the top surface to allow the fasteners to counter-sunk below said top surface.

6. The deck panel as set forth in claim 1 wherein said top surface is formed having an uneven texture so as to provide a non-slip decking surface.

7. The deck panel as set forth in claim 1 wherein said deck panel is formed from any one of a group of polypropylene compounds that is impregnated with glass fibers in a concentration of between 15 and 25%.

* * * * *